US010443910B2

(12) United States Patent
Kimura et al.

(10) Patent No.: US 10,443,910 B2
(45) Date of Patent: Oct. 15, 2019

(54) AIR CONDITIONING APPARATUS

(71) Applicant: FUJITSU GENERAL LIMITED, Kanagawa (JP)

(72) Inventors: Takashi Kimura, Kanagawa (JP); Takahiro Matsunaga, Kanagawa (JP); Makoto Shimotani, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 179 days.

(21) Appl. No.: 15/064,193

(22) Filed: Mar. 8, 2016

(65) Prior Publication Data

US 2016/0265821 A1 Sep. 15, 2016

(30) Foreign Application Priority Data

Mar. 10, 2015 (JP) ..... 2015-047641

(51) Int. Cl.
*F25B 43/02* (2006.01)
*F25B 31/00* (2006.01)
(Continued)

(52) U.S. Cl.
CPC ..... *F25B 31/004* (2013.01); *F24F 1/68* (2013.01); *F25B 13/00* (2013.01); *F25B 41/046* (2013.01);
(Continued)

(58) Field of Classification Search
CPC ..... F25B 31/004; F25B 43/02; F25B 31/002; F25B 6/02; F25B 6/04; F25B 2313/0253;
(Continued)

(56) References Cited

U.S. PATENT DOCUMENTS 5,094,598 A * 3/1992 Amata ..... F04B 39/0207 417/533
6,604,371 B2 * 8/2003 Ueno ..... F04B 39/0207 62/129
(Continued)

FOREIGN PATENT DOCUMENTS

EP 1610070 A1 12/2005
EP 2574866 A2 4/2013
(Continued)

OTHER PUBLICATIONS

Jul. 22, 2016, EP communication issued for related EP application No. 16158712.6.
May 8, 2018, Japanese Office Action issued for related JP Application No. 2015-047641.

*Primary Examiner* — Henry T Crenshaw
*Assistant Examiner* — Kamran Tavakoldavani
(74) *Attorney, Agent, or Firm* — Paratus Law Group, PLLC

(57) ABSTRACT

In an air conditioning apparatus, when the amounts of refrigerant oils retained in a first compressor and a second compressor are increased and oil levels in the first compressor and the second compressor reach a first oil outflow part and a second oil outflow part, the refrigerant oils subsequently sucked into the first compressor and the second compressor flow out of the first oil outflow part and the second oil outflow part to a first oil outflow pipe and a second oil outflow pipe, and flow from the first oil outflow pipe and the second oil outflow pipe to a refrigerant outflow pipe. The refrigerant oils flowing in the refrigerant outflow pipe from the first and second compressor through the first and second oil outflow pipe flow out of an outdoor unit through a four-way valve, and circulate through a refrigerant circuit together with refrigerants.

8 Claims, 2 Drawing Sheets

(51) Int. Cl.
*F25B 13/00* (2006.01)
*F24F 1/68* (2011.01)
*F25B 41/04* (2006.01)

(52) U.S. Cl.
CPC ..... *F25B 43/02* (2013.01); *F25B 2313/0253* (2013.01)

(58) Field of Classification Search
CPC ..... F25B 2313/0233; F25B 2500/16; F25B 13/00; F25B 41/046; F24F 1/68
See application file for complete search history.

(56) References Cited

U.S. PATENT DOCUMENTS

2014/0331712 A1* 11/2014 Kan ..... F25B 43/02 62/470
2015/0027154 A1* 1/2015 Lee ..... F25B 30/02 62/160

FOREIGN PATENT DOCUMENTS

| | | | |
|---|---|---|---|
| JP | 2007-139216 | | 6/2007 |
| JP | 2009-150628 | A | 7/2009 |
| JP | 2010-127543 | A | 6/2010 |
| JP | 2011-226714 | | 11/2011 |
| KR | 10-2009-0068136 | | 6/2009 |

* cited by examiner

AIR CONDITIONING APPARATUS

CROSS-REFERENCE TO RELATED APPLICATION

The present application claims the benefit of priority of Japanese Patent Application No. 2015-047641, filed on Mar. 10, 2015, which is incorporated herein by reference.

TECHNICAL FIELD

The present invention relates to an air conditioning apparatus, and particularly to the air conditioning apparatus including plurality of outdoor units.

BACKGROUND

An air conditioning apparatus for making connection between the plurality of outdoor units and the plurality of indoor units by refrigerant pipe is widely used conventionally. In such an air conditioning apparatus, a refrigerant flow rate in a refrigerant circuit varies greatly depending on, for example, a difference in the number of rotations of a compressor mounted in each of the outdoor units or the number of operations of the outdoor units. Since a refrigerant oil of the compressor is discharged from the compressor together with a refrigerant and flows through the refrigerant circuit, distribution of the refrigerant oil between the outdoor units may be unbalanced with variations in the refrigerant flow rate.

Known means for solving the above problem is an air conditioning apparatus having an oil equalizing pipe communicating between compressors mounted in different outdoor units as disclosed in, for example, JP-A-2011-226714. In the air conditioning apparatus disclosed in Patent Reference described above, a difference is caused in internal pressure between the compressors by changing the numbers of rotations of the plurality of compressors by a predetermined number of rotations. When the difference is caused in internal pressure between the compressors, a refrigerant oil is moved between the compressors with a pressure difference through the oil equalizing pipe, with the result that unbalance of the amount of refrigerant oil between the compressors, namely, between the outdoor units can be eliminated by sequentially changing the pressure difference between the plurality of compressors.

In the air conditioning apparatus having the plurality of outdoor units, depending on air conditioning capability required by an operated indoor unit, the number of rotations of the compressor of one outdoor unit may be made higher than the number of rotations of the compressor of the other outdoor unit. In such a case, while a large amount of refrigerant oil is discharged from the compressor of the outdoor unit driven at a high number of rotations together with a refrigerant, a small amount of refrigerant oil is discharged from the compressor of the outdoor unit driven at a low number of rotations together with the refrigerant. When such a state continues, a large amount of refrigerant oil may be unbalanced in the outdoor unit with a low number of rotations of the compressor.

In the case of using the oil equalizing pipe described in Patent Reference described above in the air conditioning apparatus as described above, it is necessary to connect the portion between the outdoor units by the oil equalizing pipe. In this case, the number of oil equalizing pipes according to the number of outdoor units installed is required, and there is a problem of increasing cost since the number of oil equalizing pipes is increased as the number of outdoor units installed is increased. Also, when one outdoor unit of the plurality of outdoor units is installed in a place separate from another outdoor unit, the length or the shape of the oil equalizing pipe must be changed according to the installation place of the outdoor unit, and there is a problem of decreasing workability in the case of installing the air conditioning apparatus.

SUMMARY OF THE INVENTION

An object of the present invention is to provide an air conditioning apparatus for eliminating unbalance of a refrigerant oil between outdoor units in a configuration with good workability at low cost based on the problems described above.

An air conditioning apparatus of the present invention has a plurality of outdoor units having at least a compressor, a discharge pipe, a suction pipe and an oil outflow pipe, and an indoor unit connected to the plurality of outdoor units by refrigerant pipe. The discharge pipe and the suction pipe are connected to the compressor. And, the compressor has an oil outflow part for causing a refrigerant oil to flow out to an outside of the compressor when a larger amount of the refrigerant oil than a necessary amount in the compressor flows in, and the oil outflow part is connected to the discharge pipe by the oil outflow pipe.

According to the air conditioning apparatus of the present invention, the surplus refrigerant oil flows out of the outdoor unit in which the larger amount of the refrigerant oil than the necessary amount flows to a refrigerant circuit to thereby eliminate unbalance of the refrigerant oil between the outdoor units. Consequently, since it is unnecessary to form an oil equalizing pipe for making connection between the outdoor units in the ease of installing the air conditioning apparatus, the cost is not increased, and workability in the case of installing the air conditioning apparatus is improved.

DETAILED DESCRIPTION

An embodiment of the present invention will hereinafter be described in detail with reference to the accompanying drawings. As the embodiment, an air conditioning apparatus in which two outdoor units are connected to ten indoor units by refrigerant pipe and cooling operation or heating operation can be performed simultaneously in all the indoor units will be described by way of example. In addition, the present invention is not limited to the following embodiment, and various modifications can be made without departing from the gist of the present invention.

EXAMPLE

Figure 1:
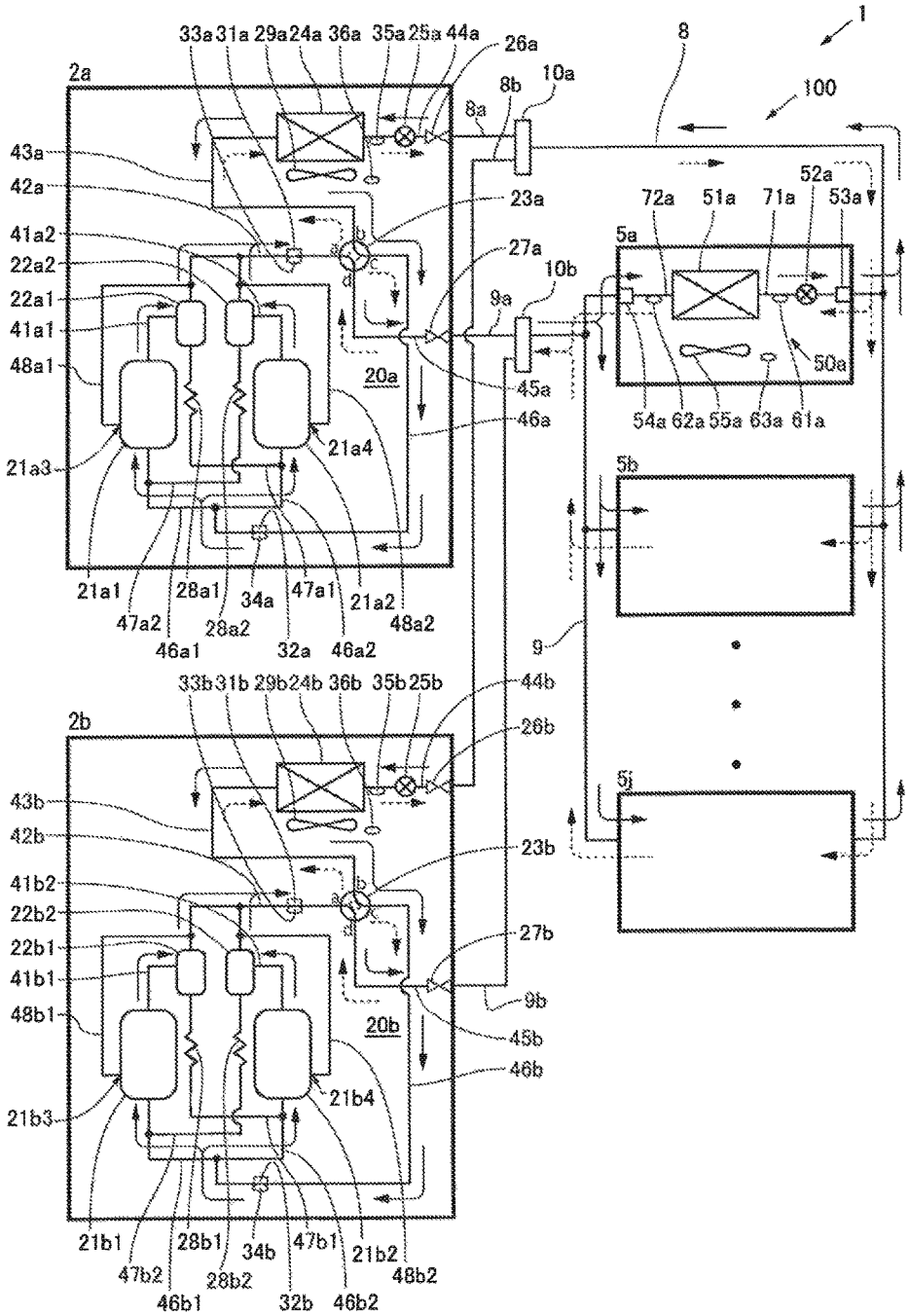
FIG. 1 is a refrigerant circuit diagram of an air conditioning apparatus in an embodiment of the present invention.

As shown in FIG. 1, an air conditioning apparatus 1 in the present embodiment includes two outdoor units 2*a*, 2*b* installed in the outside of a room, ten indoor units 5*a* to 5*j* connected to the outdoor units 2*a*, 2*b* by a liquid pipe 8 and a gas pipe 9, a liquid side branch device 10*a*, and a gas side branch device 10*b*. Specifically, one end of the liquid pipe 8 is connected to the liquid side branch device 10*a*, and the other end of the liquid pipe 8 is connected to each of liquid pipe connecting parts 53*a* to 53*j* of the indoor units 5*a* to 5*j*, respectively. A closing valve 26*a* of the outdoor unit 2*a* is connected to the liquid side branch device 10*a* by a liquid branch pipe 8*a*, and a closing valve 26*b* of the outdoor unit 2*b* is connected to the liquid side branch device 10*a* by a liquid branch pipe 8*b*, respectively. One end of the gas pipe 9 is connected to the gas side branch device 10*b*, and the other end of the gas pipe 9 is connected to each of gas pipe connecting parts 54*a* to 54*j* of the indoor units 5*a* to 5*j*, respectively. A closing valve 27*a* of the outdoor unit 2*a* is connected to the gas side branch device 1*b* by a gas branch pipe 9*a*, and a closing valve 27*b* of the outdoor unit 2*b* is connected to the gas side branch device 10*b* by a gas branch pipe 9*b*, respectively.

As described above, a refrigerant circuit 100 of the air conditioning apparatus 1 is constructed. In addition, FIG. 1 shows only three (indoor units 5*a*, 5*b* and 5*j*) of the ten indoor units 5*a* to 5*j*.

First, the outdoor units 2*a*, 2*b* will be described using FIG. 1. In addition, since the outdoor units 2*a*, 2*b* have the same configuration, in the following description, only the configuration of the outdoor unit 2*a* is described and description of the outdoor unit 2*b* is omitted. Also, in FIG. 1, a component in which a suffix of a number assigned to the component of the outdoor unit 2*a* is changed from a to b is a component of the outdoor unit 2*b* corresponding to the component of the outdoor unit 2*a*.

The outdoor unit 2*a* includes two compressors of a first compressor 21*a*1 and a second compressor 21*a*2, two oil separators of a first oil separator 22*a*1 and a second oil separator 22*a*2, a four-way valve 23*a*, an outdoor heat exchanger 24*a*, an outdoor expansion valve 25*a*, the closing valve 26*a* to which one end of the liquid branch pipe 8*a* is connected, the closing valve 27*a* to which one end of the gas branch pipe 9*a* is connected, two capillary tubes of a first capillary tube 28*a*1 and a second capillary tube 28*a*2, an outdoor fan 29*a*, a first oil outflow pipe 48*a*1 and a second oil outflow pipe 48*a*2. And, as described below in detail, each of these devices excluding the outdoor fan 29*a* is mutually connected to construct an outdoor unit refrigerant circuit 20*a* forming a part of the refrigerant circuit 100.

The first compressor 21*a*1 and a second compressor 21*a*2 are capacity variable compressors capable of varying an operating capacity by driving each of the compressors by a motor (not shown) in which the number of rotations is controlled by an inverter. A refrigerant discharge outlet of the first compressor 21*a*1 is connected to a refrigerant flow inlet of the first oil separator 22*a*1 by a first discharge pipe 41*a*1. A refrigerant discharge outlet of the second compressor 21*a*2 is connected to a refrigerant flow inlet of the second oil separator 22*a*2 by a second discharge pipe 41*a*2. One end of a first suction pipe 46*a*1 is connected to a refrigerant suction inlet of the first compressor 21*a*1, and one end of a second suction pipe 46*a*2 is connected to a refrigerant suction inlet of the second compressor 21*a*2. And, the other end of the first suction pipe 46*a*1 and the other end of the second suction pipe 46*a*2 are connected to one end of an inflow pipe 46*a*.

The refrigerant flow inlet of the first oil separator 22*a*1 is connected to the refrigerant discharge outlet of the first compressor 21*a*1 by the first discharge pipe 41*a*1, and a refrigerant flow outlet of the first oil separator 22*a*1 is connected to one refrigerant outflow pipe 42*a* whose one end is branched into two pieces. Also, connection between the first oil separator 22*a*1 and the second suction pipe 46*a*2 connected to the second compressor 21*a*2 is made by a first oil return pipe 47*a*1 including the first capillary tube 28*a*1. The first oil return pipe 47*a*1 is a pipe in which a refrigerant oil discharged from the first compressor 21*a*1 together with a refrigerant and separated from the refrigerant by the first oil separator 22*a*1 is sucked into the second compressor 21*a*2 through the second suction pipe 46*a*2. At this time, the refrigerant together with the refrigerant oil flows out of the first oil separator 22*a*1 to the first oil return pipe 47*a*1, and a refrigerant amount flowing from the first oil return pipe 47*a*1 to the second compressor 21*a*2 through the second suction pipe 46*a*2 is regulated by the first capillary tube 28*a*1.

The refrigerant flow inlet of the second oil separator 22*a*2 is connected to the refrigerant discharge outlet of the second compressor 21*a*2 by the second discharge pipe 41*a*2, and a refrigerant flow outlet of the second oil separator 22*a*2 is connected to the other refrigerant outflow pipe 42*a* whose one end is branched into two pieces. Also, connection between the second oil separator 22*a*2 and the first suction pipe 46*a*1 connected to the first compressor 21*a*1 is made by a second oil return pipe 47*a*2 including the second capillary tube 28*a*2. The second oil return pipe 47*a*2 is a pipe in which refrigerant oil discharged from the second compressor 21*a*2 together with a refrigerant and separated from the refrigerant by the second oil separator 22*a*2 is sucked into the first compressor 21*a*1 through the first suction pipe 46*a*1. At this time, the refrigerant together with the refrigerant oil flows out of the second oil separator 22*a*2 to the second oil return pipe 47*a*2, and a refrigerant amount flowing from the second oil return pipe 47*a*2 to the first compressor 21*a*1 through the first suction pipe 46*a*1 is regulated by the second capillary tube 28*a*2.

One end of the first oil outflow piper 48*a*1 is connected to the refrigerant outflow pipe 42*a* connected to the first oil separator 22*a*1, and the other end of the first oil outflow pipe 48*a*1 is connected to a first oil outflow part 21*a*3 of the first compressor 21*a*1. The first oil outflow part 21*a*3 is formed on a side surface of a hermetically closed container of the first compressor 21*a*1, and is arranged between the lower end of a motor coil (not shown) of the first compressor 21*a*1 and an oil level position at the time when refrigerant oil of the amount (the amount necessary for the first compressor 21*a*1 in the present invention, and the minimum amount necessary for the first compressor 21*a*1 to be stably driven) necessary for the first compressor 21*a*1 is retained in the first compressor 21*a*1. Consequently, when the amount of refrigerant oil retained in the first compressor 21*a*1 is increased and the oil level exceeds the first oil outflow part 21*a*3, the refrigerant oil of the amount of the oil level exceeding the first oil out flow part 21*a*3 flows out of the first oil outflow part 21*a*3 to the first oil outflow pipe 48*a*1, and flows to the refrigerant outflow pipe 42*a*.

One end of the second oil outflow pipe 48*a*2 is connected to the refrigerant outflow pipe 42*a* connected to the second oil separator 22*a*2, and the other end of the second oil outflow pipe 48*a*2 is connected to a second oil outflow part 21*a*4 of the second compressor 21*a*2. The second oil outflow part 21*a*4 is formed on a side surface of a hermetically closed container of the second compressor 21*a*2, and is arranged between the lower end of a motor coil (not shown) of the second compressor 21*a*2 and an oil level position at the time when refrigerant oil of the amount (the amount necessary for the second compressor 21*a*2 in the present invention, and the minimum amount necessary for the second compressor 21*a*2 to be stably driven) necessary for the second compressor 21*a*2 is retained in the second compressor 21*a*2. Consequently, when the amount of refrigerant oil retained in the second compressor 21*a*2 is increased and the oil level exceeds the second oil outflow part 21*a*4, the refrigerant oil of the amount of the oil level exceeding the second oil outflow part 21*a*4 flows out of the second oil outflow part 21*a*4 to the second oil outflow pipe 48*a*2, and flows to the second discharge pipe 41*a*2.

The four-way valve 23*a* is a valve for switching a flow direction of a refrigerant, and includes four ports of a, b, c and d. The other end of the refrigerant outflow pipe 42*a* described above is connected to the port a. The port b is connected to one refrigerant inlet and outlet of the outdoor heat exchanger 24*a* by refrigerant pipe 43*a*. The other end of the in flow pipe 46*a* described above is connected to the port c. And, the port d is connected to the closing valve 27*a* by an outdoor unit gas pipe 45*a*.

The outdoor heat exchanger 24*a* is means for making heat exchange between a refrigerant and the outside air taken in the outdoor unit 2*a* by rotation of the outdoor fan 29*a* described below. As described above, one refrigerant inlet and outlet of the outdoor heat exchanger 24*a* is connected to the port b of the four-way valve 23*a* by the refrigerant pipe 43*a*, and the other refrigerant inlet and outlet is connected to the closing valve 26*a* by an outdoor unit liquid pipe 44*a*.

The outdoor expansion valve 25*a* is formed on the outdoor unit liquid pipe 44*a*. The outdoor expansion valve 25*a* adjusts a refrigerant amount flowing in the outdoor heat exchanger 24*a* or a refrigerant amount flowing out of the outdoor heat exchanger 24*a* by adjusting an opening of the outdoor expansion valve 25*a*. The opening of the outdoor expansion valve 25*a* is set in a fully opened state when the air conditioning apparatus 1 performs cooling operation. Also, when the air conditioning apparatus 1 performs heating operation, it is constructed so that a discharge temperature of the compressor does not exceed a performance upper limit value of each of the compressors by performing control according to the discharge temperatures of the first compressor 21*a*1 and the second compressor 21*a*2 detected by a discharge temperature sensor 33*a* described below.

The outdoor fan 29*a* is formed of a resin material, and is arranged in the vicinity of the outdoor heat exchanger 24*a*. The outdoor fan 29*a* takes the outside air in the outdoor unit 2 from an air inlet (not shown) by rotating the outdoor fan 29*a* by a fan motor (not shown), and emits the outside air thermally exchanged with a refrigerant in the outdoor heat exchanger 24*a* from an air outlet (not shown) to the outside of the outdoor unit 2.

In addition to the configuration described above, the outdoor unit 2*a* is provided with various sensors. As shown in FIG. 1, the refrigerant outflow pipe 42*a* is provided with a high-pressure sensor 31*a* for detecting pressures of refrigerants discharged from the first compressor 21*a*1 and the second compressor 21*a*2, and the discharge temperature sensor 33*a* for detecting temperatures of refrigerants discharged from the first compressor 21*a*1 and the second compressor 21*a*2. The inflow pipe 46*a* is provided with a low-pressure sensor 32*a* for detecting pressures of refrigerants sucked into the first compressor 21*a*1 and the second compressor 21*a*2, and a suction temperature sensor 34*a* for detecting temperatures of refrigerants sucked into the first compressor 21*a*1 and the second compressor 21*a*2.

A heat exchange temperature sensor 35*a* for detecting a temperature of a refrigerant flowing in the outdoor heat exchanger 24*a* or a temperature of a refrigerant flowing out of the outdoor heat exchanger 24*a* is formed between the outdoor expansion valve 25*a* and the outdoor heat exchanger 24*a* in the outdoor unit liquid pipe 44*a*. And, the vicinity of an air inlet (not shown) of the outdoor unit 2*a* is provided with an outside air temperature sensor 36*a* for detecting a temperature of the outside air flowing in the outdoor unit 2*a*, that is, an outside air temperature.

Next, the ten indoor units 5*a* to 5*j* will be described. In addition, since the ten indoor units 5*a* to 5*j* have the same configuration, as described above, FIG. 1 shows only the three indoor units 5*a*, 5*b* and 5*j*, and shows each device constructing the indoor unit 5*a* in only the indoor unit 5*a*. Consequently, in the following description, only the configuration of the indoor unit 5*a* is described and description of the other indoor units 5*b* to 5*j* is omitted. Also, in FIG. 1, components in which a suffix of a number assigned to the component of the indoor unit 5*a* is respectively changed from a to b-j are components of the indoor units 5*b* to 5*j* corresponding to the component of the indoor unit 5*a*.

The indoor unit 5*a* includes an indoor heat exchanger 51*a*, an indoor expansion valve 52*a*, the liquid pipe connecting part 53*a* to which the other end of the branched liquid pipe 8 is connected, the gas pipe connecting part 54*a* to which the other end of the branched gas pipe 9 is connected, and an indoor fan 55*a*. And, each of these devices excluding the indoor fan 55*a* is mutually connected by each refrigerant pipe described below in detail to construct an indoor unit refrigerant circuit 50*a* forming a part of the refrigerant circuit 100.

The door heat exchanger 51*a* is means for making heat exchange between a refrigerant and the inside air taken in the indoor unit 5*a* from an air inlet (not shown) by rotation of the indoor fan 55*a* described below. One refrigerant inlet and outlet of the indoor heat exchanger 51*a* is connected to the liquid pipe connecting part 53*a* by an indoor unit liquid pipe 71*a*, and the other refrigerant inlet and outlet of the indoor heat exchanger 51*a* is connected to the gas pipe connecting part 54*a* by an indoor unit gas pipe 72*a*. The indoor heat exchanger 51*a* functions as an evaporator when the indoor unit 5*a* performs cooling operation, and functions as a condenser when the indoor unit 5*a* performs heating operation.

In addition, the liquid pipe connecting part 53*a* gas pipe connecting part 54*a* is connected to each refrigerant pipe by welding, a flare nut, etc.

The indoor expansion valve 52*a* is formed on the indoor unit liquid pipe 71*a*. When the indoor heat exchanger 51*a* functions as the evaporator, an opening of the indoor expansion valve 52*a* is adjusted so that a refrigerant superheating degree in a refrigerant outlet (side of the gas pipe connecting part 54*a*) of the indoor heat exchanger 51*a* becomes a target refrigerant superheating degree, and when the indoor heat exchanger 51*a* functions as the condenser, the opening of the indoor expansion valve 52*a* is adjusted so that a refrigerant supercooling degree in a refrigerant outlet (side of the liquid pipe connecting part 53*a*) of the indoor heat exchanger 51*a* becomes a target refrigerant supercooling degree. Here, the target refrigerant superheating degree and the target refrigerant supercooling degree are the refrigerant superheating degree and the refrigerant supercooling degree for exerting sufficient heating capacity and cooling capacity in the indoor unit 5*a*.

The indoor fan 55*a* is formed of a resin material, and is arranged in the vicinity of the indoor heat exchanger 51*a*. The indoor fan 55*a* takes the inside air in the indoor unit 5*a* from an air inlet (not shown) by rotating the indoor fan 55*a* by a fan motor (not shown), and supplies the inside air thermally exchanged with a refrigerant in the indoor heat exchanger 51*a* from an air outlet (not shown) to the inside of the indoor unit 5*a*.

In addition to the configuration described above, the indoor unit 5*a* is provided with various sensors. A liquid side temperature sensor 61*a* for detecting a temperature of a liquid refrigerant flowing in the indoor heat exchanger 51*a* or flowing out of the indoor heat exchanger 51*a* is formed between the indoor expansion valve 52*a* and the indoor heat exchanger 51*a* in the indoor unit liquid pipe 71*a*. The indoor unit gas pipe 72*a* is provided with a gas side temperature sensor 62*a* for detecting a temperature of a gas refrigerant flowing in the indoor heat exchanger 51*a* or flowing out of the indoor heat exchanger 51*a*. And, the vicinity of an air inlet (not shown) of the indoor unit 5*a* is provided with an inside temperature sensor 63*a* for detecting a temperature of the inside air flowing in the indoor unit 5*a*, that is, an inside temperature.

Next, an action of each part and a flow of a refrigerant in the refrigerant circuit 100 at the time of air conditioning operation of the air conditioning apparatus 1 in the embodiment will be described using FIG. 1. In the following description, first, the case where the indoor units 5*a* to 5*j* perform heating operation will be described and next, the case where the indoor units 5*a* to 5*j* perform cooling operation will be described. In addition, in the following description, since all the indoor units 5*a* to 5*j* perform heating operation or cooling operation, the outdoor unit requires a high operating capacity and accordingly, both of the outdoor unit 2*a* and the outdoor unit 2*b* are operated and the first compressor 21*a*1 and the second compressor 21*a*2 of the outdoor unit 2*a* are driven and also the first compressor 21*b*1 and the second compressor 21*b*2 of the outdoor unit 2*b* are driven.

Also, in FIG. 1, a state of connection between the four ports in the four-way valves 23*a*, 23*b* at the time of heating operation is shown by solid lines, and a state of connection between the four ports in the four-way valves 23*a*, 23*b* at the time of cooling operation is shown by broken lines. Also, the flow of the refrigerant at the time of heating operation in the refrigerant circuit 100 is shown by solid line arrows, and the flow of the refrigerant at the time of cooling operation is shown by broken line arrows. However, since the flow of the refrigerant between the four-way valve 23*a* and the first compressor 21*a*1 and the second compressor 21*a*2, and the flow of the refrigerant between the four-way valve 23*b* and the first compressor 21*b*1 and the second compressor 21*b*2 are the same at the time of heating operation and cooling operation, the flows are shown by only solid line arrows.

<Heating Operation>

When the indoor units 5*a* to 5*j* perform heating operation, the four-way valves 23*a*, 23*b* are switched in a state shown by solid lines, that is, so as to provide communication between the ports a and d, and the ports b and c of the four-way valves 23*a*, 23*b*1. Accordingly, the outdoor heat exchangers 24*a*, 24*b* function as evaporators and also, the indoor heat exchangers 51*a* to 51*j* function as condensers. After the four-way valves 23*a*, 23*b* are switched as described above, the first compressors 21*a*1, 21*b*1 and the second compressors 21*a*2, 21*b*2 are started.

High-pressure refrigerants discharged from the first compressors 21*a*1, 21*b*1 flow in the first oil separators 22*a*1, 22*b*1 through the first discharge pipes 41*a*1, 41*b*1. The refrigerants discharged from the first compressors 21*a*1, 21*b*1 include refrigerant oils retained in the first compressors 21*a*1, 21*b*1, but the refrigerant oils are separated from the refrigerants by the first oil separators 22*a*1, 22*b*1, and only the refrigerants flow out of the first oil separators 22*a*1, 22*b*1 to the refrigerant outflow pipes 42*a*, 42*b*. In addition, the refrigerant oils separated from the refrigerants by the first oil separators 22*a*1, 22*b*1 flow out to the first oil return pipes 47*a*1, 47*b*1, and are sucked into the second compressors 21*a*2, 21*b*2 from the first capillary tubes 28*a*1, 28*b*1 through the second suction pipes 46*a*2, 46*b*2.

High-pressure refrigerants discharged from the second compressors 21*a*2, 21*b*2 flow in the second oil separators 22*a*2, 22*b*2 through the second discharge pipes 41*a*2, 41*b*2. The refrigerants discharged from the second compressors 21*a*2, 21*b*2 include refrigerant oils retained in the second compressors 21*a*2, 21*b*2, but the refrigerant oils are separated from the refrigerants by the second oil separators 22*a*2, 22*b*2, and only the refrigerants flow out of the second oil separators 22*a*2, 22*b*2 to the refrigerant outflow pipes 42*a*, 42*b*. In addition, the refrigerant oils separated from the refrigerants by the second oil separators 22*a*2, 22*b*2 flow out to the second oil return pipes 47*a*2, 47*b*2, and are sucked into the first compressors 21*a*1, 21*b*1 from the second capillary tubes 28*a*2, 28*b*2 through the first suction pipes 46*a*1, 46*b*1.

The refrigerants flowing out of the first oil separators 22*a*1, 22*b*1 and the second oil separators 22*a*2, 22*b*2 to the refrigerant outflow pipes 42*a*, 42*b* flow through the outdoor unit gas pipes 45*a*, 45*b* through the four-way valves 23*a*, 23*b*, and flow in the gas branch pipes 9*a*, 9*b* through the gas side closing valves 27*a*, 27*b*. The refrigerants flowing in the gas branch pipes 9*a*, 9*b* are together joined at the gas side branch device 10*b* and flow out to the gas pipe 9.

The refrigerant flowing through the gas pipe 9 is branched into the gas pipe connecting parts 54*a* to 54*j*, and flows in the indoor units 5*a* to 5*j*. The refrigerants flowing in the indoor units 5*a* to 5*j* flow through the indoor unit gas pipes 72*a* to 72*j*, and flow in the indoor heat exchangers 51*a* to 51*j*, and are condensed by heat exchange with the inside air taken in the indoor units 5*a* to 5*j* by rotating the indoor fans 55*a* to 55*j*. Thus, the indoor heat exchangers 51*a* to 51*j* function as the condensers, and the inside air heated by heat exchange with the refrigerants by the indoor heat exchangers 51*a* to 51*j* is blown from an air outlet (not shown) to the inside of a room to thereby heat the inside of the room in which the indoor units 5*a* to 5*j* are installed.

The refrigerants flowing out of the indoor heat exchangers 51*a* to 51*j* flow through the indoor unit liquid pipes 71*a* to 71*j*, and are depressurized through the indoor expansion valves 52*a* to 52*j*. The depressurized refrigerants flow through the indoor unit liquid pipes 71*a* to 71*j* and the liquid pipe connecting parts 53*a* to 53*j*, and flow in the liquid pipe 8. The refrigerant flowing in the liquid pipe 8 is branched into the liquid branch pipes 8*a*, 8*b* by the liquid side branch device 10*a*.

The refrigerants branched into the liquid branch pipes 8*a*, 8*b* flow in the outdoor units 2*a*, 2*b* through the liquid side closing valves 26*a*, 26*b*. The refrigerants flowing in the outdoor units 2*a*, 2*b* flow through the outdoor unit liquid pipes 44*a*, 44*b*, and are further depressurized at the time of passing through the outdoor expansion valves 25*a*, 25*b* set in the openings according to discharge temperatures of the first compressors 21*a*1, 21*b*1 and the second compressors 21*a*2, 21*b* detected by the discharge temperature sensors 33*a*, 33*b*. The refrigerants flowing from the outdoor unit liquid pipes 44*a*, 44*b* in the outdoor heat exchangers 24*a*, 24*b* are evaporated by heat exchange with the outside air taken in the outdoor units 2*a*, 2*b* by rotating the outdoor fans 29*a*, 29*b*. The refrigerants flowing out of the outdoor heat exchangers 24*a*, 24*b* flow from the refrigerant pipe 43*a*, 43*b* to the inflow pipes 46*a*, 46*b* through the four-way valves 23*a*, 23*b*, and are branched from the inflow pipes 46*a*, 46*b* to the first suction pipes 46*a*1, 46*b*1 and the second suction pipes 46a2, 46b2, and are sucked into the first compressors 21a1, 21b1 and the second compressors 21a2, 21b2, and are again compressed.

As described above, the refrigerants circulate through the refrigerant circuit 100 to thereby perform the heating operation of the air conditioning apparatus 1.

<Cooling Operation>

When the indoor units 5a to 5j perform cooling operation, the four-way valves 23a, 23b are switched in a state shown by broken lines, that is, so as to provide communication between the ports a and h, and the ports c and d of the four-way valves 23a, 23b. Accordingly, the outdoor heat exchangers 24a, 24b function as condensers and also, the indoor heat exchangers 51a to 51j function as evaporators. After the four-way valves 23a, 23b are switched as described above, the first compressors 21a1, 21b1 and the second compressors 21a2, 21b2 are started.

In addition, since a flow of a refrigerant between the four-way valves 23a, and the first compressors 21a1, 21b1 and the second compressors 21a2, 21b2 is the same as that at the time of the heating operation described above, detailed description is omitted.

The refrigerants flowing from the four-way valves 23a, 23b in the outdoor heat exchangers 24a, 24b through the refrigerant pipe 43a, 43b are condensed by heat exchange with the outside air taken in the outdoor units 2a, 2b by rotating the outdoor fans 29a, 29b. The refrigerants flowing out of the outdoor heat exchangers 24a, 24b to the outdoor unit liquid pipes 44a, 44b pass through the outdoor expansion valves 25a, 25b set in fully opened states, and flow in the liquid branch pipes 8a, 8b through the liquid side closing valves 26a, 26b. The refrigerants flowing in the liquid branch pipes 8a, 8b are together joined at the liquid side branch device 10a and flow out to the liquid pipe 8.

The refrigerant flowing through the liquid pipe 8 is branched into the liquid pipe connecting parts 53a to 53j, and flows in the indoor units 5a to 5j. The refrigerants flowing in the indoor units 5a to 5j flow through the indoor unit liquid pipes 71a to 71j, and are depressurized through the indoor expansion valves 52a to 52j. The refrigerants depressurized by the indoor expansion valves 52a to 52j flow in the indoor heat exchangers 51a to 51j, and are evaporated by heat exchange with the inside air taken in the indoor units 5a to 5j by rotating the indoor fans 55a to 55j. Thus, the indoor heat exchangers 51a to 51j function as the evaporators, and the inside air cooled by heat exchange with the refrigerants by the indoor heat exchangers 51a to 51j is blown from an air outlet (not shown) to the inside of a room to thereby cool the inside of the room in which the indoor units 5a to 5j are installed.

The refrigerants flowing out of the indoor heat exchangers 51a to 51j flow through the indoor unit gas pipes 72a to 74 and flow in the gas pipe 9 through the gas pipe connecting parts 54a to 54j. The refrigerant flowing in the gas pipe 9 is branched into the gas branch pipes 9a, 9b by the gas side branch device 10b, and flows in the outdoor units 2a, 2b through the gas side closing valves 27a, 27b. The refrigerants flowing in the outdoor units 2a, 2b flow from the outdoor unit gas pipes 45a, 45b to the four-way valves 23a, 23b.

As described above, the refrigerants circulate through the refrigerant circuit 100 to thereby perform the cooling operation of the air conditioning apparatus 1.

Next, the action and effect of the first oil outflow pipes 48a1, 48b1 and the second oil outflow pipes 48a2, 48b2 in the air conditioning apparatus 1 of the embodiment will be described using FIGS. 1 and 2. In addition, in FIG. 2, a flow of refrigerant oils flowing out of the first oil outflow parts 21a3, 21b3 of the first compressors 21a1, 21b1 is shown by a solid line arrow 200a. Also, a flow of refrigerant oils flowing out of the second oil outflow parts 21a4, 21b1 of the second compressors 21a2, 21b2 is shown by a solid line arrow 200b. Also, a flow of refrigerant oils discharged from the first compressors 21a1, 21b, to the first discharge pipes 41a1, 41b1 together with refrigerants is shown by a broken line arrow 300a, and a flow of refrigerant oils discharged from the second compressors 21a2, 21b2 to the second discharge pipes 41a2, 41b2 together with refrigerants is shown by a broken line arrow 300b.

When the indoor units 5a to 5j are connected to the outdoor units 2a, 2b like the air conditioning apparatus 1 of the embodiment, depending on air conditioning capability required by the operated indoor units 5a to 5j, for example, the numbers of rotations of the first compressor 21a1 and the second compressor 21a2 of the outdoor unit 2a may be made higher than the numbers of rotations of the first compressor 21b1 and the second compressor 21b2 of the outdoor unit 2b.

In the case described above, large amounts of refrigerant oils are discharged from the first compressor 21a1 and the second compressor 21a2 of the outdoor unit 2a driven at high numbers of rotations together with refrigerants. Consequently, the refrigerant oils may flow out of the outdoor unit 2a to the refrigerant circuit 100 since the refrigerant oils cannot be completely separated from the refrigerants by the first oil separator 22a1 and the second oil separator 22a2 of the outdoor unit 2a. On the other hand, small amounts of refrigerant oils are discharged from the first compressor 21b1 and the second compressor 21b2 of the outdoor unit 2b driven at lower numbers of rotations than those of the first compressor 21a1 and the second compressor 21a2 of the outdoor unit 2a together with refrigerants. Further, the discharged refrigerant oils are completely separated from the refrigerants by the first oil separator 22b1 and the second oil separator 22b2 of the outdoor unit 2b, and are sucked into the first compressor 21b1 and the second compressor 21b2 of the outdoor unit 2b through the first oil return pipe 47b1 and the second oil return pipe 47b2 of the outdoor unit 2b.

That is, in the outdoor unit 2a, the amount of refrigerant oil flowing in the outdoor unit 2a from the refrigerant circuit 100 becomes smaller than the amount of refrigerant oil flowing out of the outdoor unit 2a, Also, in the outdoor unit 2b, the amount of refrigerant oil flowing in the outdoor unit 2b from the refrigerant circuit 100 becomes larger than the amount of refrigerant oil flowing out of the outdoor unit 2b. When such a state continues, a large amount of refrigerant may be unbalanced in the outdoor unit 2b.

However, the air conditioning apparatus 1 of the embodiment includes the first oil outflow pipes 48a1, 48b1 for making connection between the refrigerant outflow pipes 42a, 42b and the first oil outflow parts 21a3, 21b3 formed in positions corresponding to oil levels of the amounts of refrigerant oils necessary for the first compressors 21a1, 21b1, and the second oil outflow pipes 48a2, 48b2 for making connection between the refrigerant outflow pipes 42a, 42b and the second oil outflow parts 21a4, 21b4 formed in positions corresponding to oil levels of the amounts of refrigerant oils necessary for the second compressors 21a2, 21b2.

Accordingly, the refrigerant oil is unbalanced in any of the outdoor units 2a, 2b, and the refrigerant oil excessively flowing in any of the first compressors 21a1, 21b1 or the second compressors 21a2, 21b2 flows out of the first oil outflow pipes 48a1, 48b1 or the second oil outflow pipes 48*a*2, 48*b*2 regardless of the number of rotations of the compressor. Consequently, unbalance of the refrigerant oil between the outdoor units is eliminated without performing special control for causing the refrigerant oil to flow out of the outdoor unit with the refrigerant oil unbalanced, for example, the control in which a difference is caused in internal pressure between the compressors by making the number of rotations of the compressor of one outdoor unit higher than the number of rotations of the compressor of the other outdoor unit by a predetermined number of rotations.

Also, since the first oil outflow pipes 48*a*1, 48*b*1 and the second oil outflow pipes 48*a*2, 48*b*2 are previously formed on the outdoor units 2*a*, 2*b*, the need for special installation work of eliminating unbalance of the refrigerant between the outdoor units 2*a*, 2*b* is eliminated, with the result that workability in the case of installing the outdoor units 2*a*, 2*b* is improved, and the cost of the air conditioning apparatus 1 can be reduced.

Next, elimination of unbalance of a refrigerant between both of the outdoor units by action of the first oil outflow pipes 48*a*1, 48*b*1 and the second oil outflow pipes 48*a*2, 48*b*2 in the case where refrigerant oil is unbalanced in one of the outdoor units 2*a*, 2*b* will be described using FIG. 2. In addition, the following description gives the case where the first compressor 21*a*1 and the second compressor 21*a*2 included in the outdoor unit 2*a* are driven at higher numbers of rotations than those of the first compressor 21*b*1 and the second compressor 21*b*2 included in the outdoor unit 2*b* and the amount of refrigerant oil flowing in the outdoor unit 2*a* becomes smaller than the amount of refrigerant oil flowing out of the outdoor unit 2*a* and also the amount of refrigerant oil flowing in the outdoor unit 2*b* becomes larger than the amount of refrigerant oil flowing out of the outdoor unit 2*b* and thereby the amount of refrigerant oil present in the outdoor unit 2*b* becomes larger than the amount of refrigerant oil present in the outdoor unit 2*a*, that is, the refrigerant oil is unbalanced in the outdoor unit 2*b*.

Figure 2:
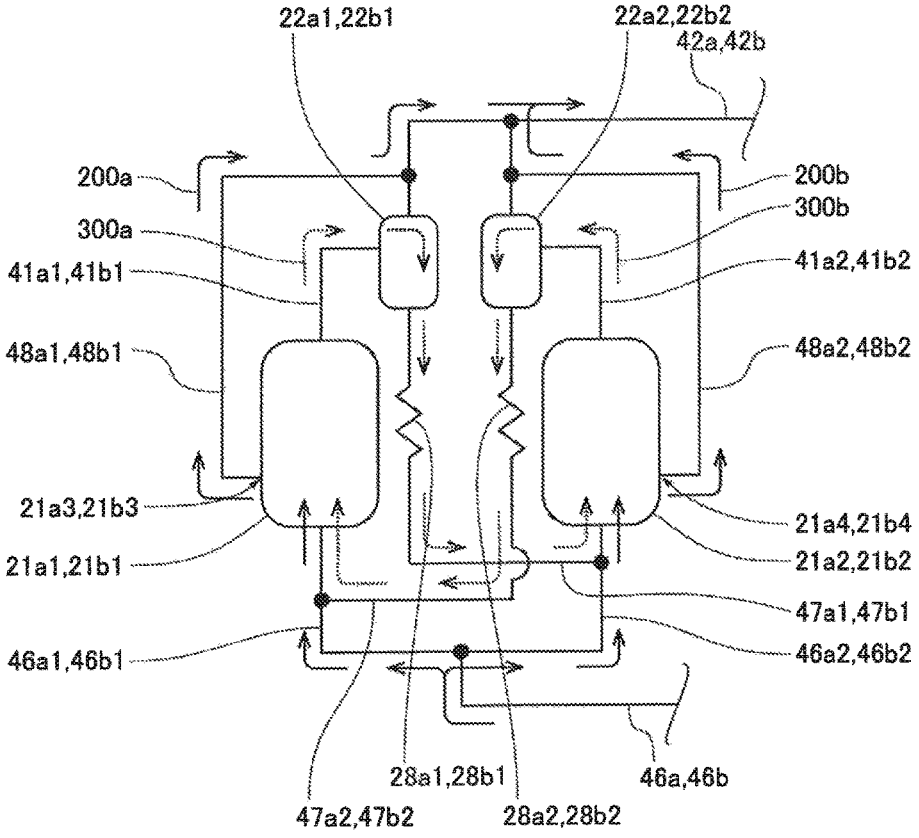
FIG. 2 is a main circuit diagram describing the inflow and outflow of a refrigerant oil in a compressor.

When the first compressors 21*a*1, 21*b*1 are driven, the refrigerant oils circulating through the refrigerant circuit 100 from the inflow pipes 46*a*, 46*b* through the first suction pipes 46*a*1, 46*b*1 together with refrigerants are sucked into the first compressors 21*a*1, 21*b*1 as shown by the solid line arrow 200*a* of FIG. 2. On the other hand, as shown by the broken line arrow 300*a* of FIG. 2, the refrigerant oils discharged from the first compressors 21*a*1, 21*b*1 together with the refrigerants are separated from the refrigerants by the first oil separators 22*a*1, 22*b*1, and flow out to the first oil return pipes 47*a*1, 47*b*1, and are sucked into the second compressors 21*a*2, 21*b*2 from the first oil return pipes 47*a*1, 47*b*1 through the second suction pipes 46*a*2, 46*b*2.

When the second compressors 21*a*2, 21*b*2 are driven, the refrigerant oils circulating through the refrigerant circuit 100 from the inflow pipes 46*a*, 46*b* through the second suction pipes 46*a*2, 46*b*2 together with refrigerants are sucked into the second compressors 21*a*2, 21*b*2 as shown by the solid line arrow 200*b* of FIG. 2. On the other hand, as shown by the broken line arrow 300*b* of FIG. 2, the refrigerant oils discharged from the second compressors 21*a*2, 21*b*2 together with the refrigerants are separated from the refrigerants by the second oil separators 22*a*2, 22*b*2, and flow out to the second oil return pipes 47*a*2, 47*b*2, and are sucked into the first compressors 21*a*1, 21*b*1 from the second oil return pipes 47*a*2, 47*b*2 through the first suction pipes 46*a*1, 46*b*1.

When the refrigerant oils flow through the outdoor units 2*a*, 2*b* as described above, the refrigerant is unbalanced in the outdoor unit 2*b*, and the large amounts of refrigerant oils flow in the first compressor 21*b*1 and the second compressor 21*b*2, and the amounts of refrigerant oils retained in the first compressor 21*b*1 and the second compressor 21*b*2 are increased. Then, when an oil level in the first compressor 21*b*1 reaches the first oil out-flow part 21*b*3 and an oil level in the second compressor 21*b*2 reaches the second oil outflow part 21*b*4, the refrigerant oils (the excessive refrigerant oils in the first compressor 21*b*1 and the second compressor 21*b*2) subsequently sucked into the first compressor 21*b*1, and the second compressor 21*b*2 flow out of the first oil outflow part 21*b*3 and the second oil outflow part 21*b*4 to the first oil out-flow pipe 48*b*1 and the second oil outflow pipe 48*b*2, and flow from the first oil outflow pipe 48*b*1 and the second oil outflow pipe 48*b*2 to the refrigerant outflow pipe 42*b* as shown by the arrows 200*a*, 200*b* of FIG. 2.

The refrigerant oils flowing in the refrigerant outflow pipe 42*b* from the first compressor 21*b*1 and the second compressor 21*b*2 through the first oil outflow pipe 48*b*1 and the second oil outflow pipe 48*b*2 flow out of the outdoor unit 2*b* from the four-way valve 23*b* through the outdoor unit gas pipe 45*b* at the time of heating operation, and from the four-way valve 23*b* through the outdoor heat exchanger 24*b* and the outdoor expansion valve 25*b* at the time of cooling operation, respectively, and the refrigerant oils circulate through the refrigerant circuit 100 together with the refrigerants.

As described above, in the air conditioning apparatus 1 of the embodiment, the refrigerant oil unbalanced and distributed in the outdoor unit 2*b* flows out of the outdoor unit 2*b* to the refrigerant circuit 100, with the result that the refrigerant oil flowing out to the refrigerant circuit 100 spreads over the outdoor unit 2*a*, and unbalance of the refrigerant between the outdoor unit 2*a* and the outdoor unit 2*b* is eliminated.

In addition, the embodiment of the present invention described above shows the case where the air conditioning apparatus 1 includes the first oil separators 22*u*1, 22*b*1 and the second oil separators 22*a*2, 22*b*2, but the first oil outflow pipes 48*a*1, 48*b*1 and the second oil outflow pipes 48*a*2, 48*b*2 may be connected to the first discharge pipes 41*a*1, 41*b*1 and the second discharge pipes 41*a*2, 41*b*2 without forming each of these oil separators.

In addition, the present invention is not limited by the embodiment of the present invention described above and has at least of features as described following (1) or (2).

(1) An air conditioning apparatus comprises a plurality of outdoor units having at least a compressor, a discharge pipe, a suction pipe, and an oil outflow pipe, and an indoor unit connected to the plurality of outdoor units through a refrigerant pipe, wherein the discharge pipe and the suction pipe are connected to the compressor, and the compressor has an oil outflow part for causing a refrigerant oil to flow out to an outside of the compressor when a larger amount of the refrigerant oil than a necessary amount in the compressor flows into the compressor, and the oil outflow part is connected to the discharge pipe by the oil outflow pipe, (2) The air conditioning apparatus according to (1), wherein the outdoor unit includes an oil separator and a refrigerant outflow pipe, wherein one end of the discharge pipe is connected to the compressor and also the other end of the discharge pipe is connected to the oil separator, wherein the refrigerant outflow pipe is connected to the oil separator, and wherein the oil outflow part is connected to the refrigerant outflow pipe by the oil outflow pipe.

The invention claimed is:

1. An air conditioning apparatus comprising:
a plurality of outdoor units; and
an indoor unit connected to the plurality of outdoor units through a refrigerant pipe,
wherein each of the plurality of outdoor units includes:
a refrigerant discharge pipe and a refrigerant suction pipe;
a compressor to which the refrigerant discharge pipe and the refrigerant suction pipe are connected, and which has an oil outflow opening on the compressor for allowing a refrigerant oil to flow out to an outside of the compressor when a larger amount of the refrigerant oil than a necessary amount in the compressor flows into the compressor;
an oil outflow pipe which connects the oil outflow opening to the refrigerant discharge pipe to thereby provide a flow of the refrigerant oil from the oil outflow opening to the refrigerant discharge pipe;
an oil separator; and
a refrigerant outflow pipe,
wherein one end of the refrigerant discharge pipe of each outdoor unit is directly connected to the compressor of the same outdoor unit and also the other end of the refrigerant discharge pipe of each outdoor unit is directly connected to the oil separator of the same outdoor unit,
wherein the refrigerant outflow pipe of each outdoor unit is directly connected to the oil separator of the same outdoor unit, and
wherein the oil outflow opening of each outdoor unit is directly connected to the refrigerant outflow pipe of the same outdoor unit by the oil outflow pipe of the same outdoor unit.

2. The air conditioning apparatus according to claim 1,
wherein the oil outflow opening of each outdoor unit is formed on a side surface of the compressor of the same outdoor unit at a position associated with an oil level that is greater than a minimum oil level threshold.

3. The air conditioning apparatus according to claim 2,
wherein when an amount of the refrigerant oil retained in the compressor of any respective one of the plurality of outdoor units exceeds the oil level associated with the position at which the oil outflow opening of the same respective one of the plurality of outdoor units is formed, the refrigerant oil flows out of the oil outflow opening of the same respective one of the plurality of outdoor units and into the oil outflow pipe of the same respective one of the plurality of outdoor units.

4. The air conditioning apparatus according to claim 3,
wherein the refrigerant oil that has flowed out of the oil outflow opening of any respective one of the plurality of outdoor units and into the oil outflow pipe of the same respective one of the plurality of outdoor units, is delivered by the oil outflow pipe of the same respective one of the plurality of outdoor units to the refrigerant discharge pipe of the same respective one of the plurality of outdoor units.

5. The air conditioning apparatus according to claim 1,
wherein when an amount of the refrigerant oil retained in the compressor of any respective one of the plurality of outdoor units exceeds the oil outflow opening of the same respective one of the plurality of outdoor units, the refrigerant oil of an amount of oil level exceeding the oil outflow opening of the same respective one of the plurality of outdoor units flows out of the oil outflow opening of the same respective one of the plurality of outdoor units and into the oil outflow pipe of the same respective one of the plurality of outdoor units.

6. An air conditioning apparatus comprising:
a plurality of outdoor units; and
an indoor unit connected to the plurality of outdoor units through a refrigerant pipe,
wherein each of the plurality of outdoor units includes:
a refrigerant discharge pipe and a refrigerant suction pipe;
a compressor to which the refrigerant discharge pipe and the refrigerant suction pipe are connected, and which has an oil outflow opening on the compressor for allowing a refrigerant oil to flow out to an outside of the compressor when a larger amount of the refrigerant oil than a necessary amount in the compressor flows into the compressor;
an oil outflow pipe which connects the oil outflow opening to the refrigerant discharge pipe to thereby provide a flow of the refrigerant oil from the oil outflow opening to the refrigerant discharge pipe; and
a refrigerant outflow pipe having one end that is branched into two pieces that connect to the refrigerant discharge pipe and a second refrigerant discharge pipe of a second compressor in the same outdoor unit.

7. An air conditioning apparatus comprising:
a plurality of outdoor units; and
an indoor unit connected to the plurality of outdoor units through a refrigerant pipe,
wherein each of the plurality of outdoor units includes:
a refrigerant discharge pipe and a refrigerant suction pipe;
a compressor to which the refrigerant discharge pipe and the refrigerant suction pipe are connected, and which has an oil outflow opening on the compressor for allowing a refrigerant oil to flow out to an outside of the compressor when a larger amount of the refrigerant oil than a necessary amount in the compressor flows into the compressor;
an oil outflow pipe which connects the oil outflow opening to the refrigerant discharge pipe to thereby provide a flow of the refrigerant oil from the oil outflow opening to the refrigerant discharge pipe; and
a refrigerant outflow pipe,
wherein one end of the oil outflow pipe of each outdoor unit is directly connected to the oil outflow opening of the same outdoor unit and the other end of the oil outflow pipe of each outdoor unit is directly connected to the refrigerant outflow pipe of the same outdoor unit.

8. An air conditioning apparatus comprising:
a plurality of outdoor units; and
an indoor unit connected to the plurality of outdoor units through a refrigerant pipe,
wherein each of the plurality of outdoor units includes:
a discharge pipe and a suction pipe;
an oil separator;
a refrigerant outflow pipe;
a compressor to which the discharge pipe and the suction pipe are connected, and which has an oil outflow opening for allowing a refrigerant oil to flow out to an outside of the compressor when a larger amount of the refrigerant oil than a necessary amount in the compressor flows into the compressor; and an oil outflow pipe that directly connects the oil outflow opening to the refrigerant outflow pipe, wherein one end of the discharge pipe of each outdoor unit is directly connected to a refrigerant discharge outlet of the compressor of the same outdoor unit, and the other end of the discharge pipe of each outdoor unit is directly connected to the oil separator of the same outdoor unit, and wherein the refrigerant outflow pipe of each outdoor unit is connected to the oil separator of the same outdoor unit.

* * * * *